US006012943A

United States Patent [19]

Wu

[11] Patent Number: 6,012,943

[45] Date of Patent: Jan. 11, 2000

[54] INSULATION DISPLACEMENT CONNECTOR

[75] Inventor: Kun-Tsan Wu, Tu-Chen, Taiwan

[73] Assignee: Hon Hai Precision Ind. Co., Ltd., Taipei Hsien, Taiwan

[21] Appl. No.: 08/891,573

[22] Filed: Jul. 11, 1997

[30] Foreign Application Priority Data

Aug. 10, 1996 [TW] Taiwan ..... 85212377

[51] Int. Cl.[7] ..... H01R 4/24

[52] U.S. Cl. ..... 439/404

[58] Field of Search ..... 439/404, 405, 439/441

[56] References Cited

U.S. PATENT DOCUMENTS

| | | | |
|---|---|---|---|
| 4,938,711 | 7/1990 | Davis et al. | 439/404 |
| 5,061,203 | 10/1991 | Allgood et al. | 439/441 |
| 5,104,336 | 4/1992 | Hatanaka et al. | 439/404 |
| 5,108,306 | 4/1992 | Wellinsky | 439/404 |
| 5,451,170 | 9/1995 | Suffi | 439/404 |
| 5,620,331 | 4/1997 | Los et al. | 439/404 |
| 5,762,513 | 6/1998 | Stine | 439/404 |
| 5,820,403 | 10/1998 | Cheng et al. | 439/404 |

*Primary Examiner*—Michael L. Gellner
*Assistant Examiner*—Briggitte R Hammond

[57] ABSTRACT

An insulation displacement connector for terminating a ribbon cable consists of a connector housing, a number of contacts received in the connector housing, a locating member connected with the connector housing and a termination cover also connected with the connector housing. Each of the contacts has a tab extending through a contact passage in the connector housing, a piercing device received in a recess in the termination cover, and a connecting section located between the tab and the piercing device and fixedly received in a locating hole defined in the locating member. The locating member has two lateral sides each making up a pair of guides extending into the termination cover. The guides restrain and guide the movement of the outer insulation piercing points of the piercing device at the outermost contacts located most distant from the middle line amid two lateral sides of the connector housing, when the connector housing, which has been assembled with the contacts and the locating member, connects the termination cover and terminates the cable.

11 Claims, 5 Drawing Sheets

INSULATION DISPLACEMENT CONNECTOR

BACKGROUND OF THE INVENTION

1. Field of the Invention

The invention relates to an insulation displacement connector, particularly to an insulation displacement connector that can precisely and correctly terminate a multi-conductor cable while an improper deformation of the outer insulation piercing points of the piercing devices on the outermost contacts can be prevented.

2. The Prior Art

Insulation displacement connectors, also known as flat cable connectors or ribbon cable connectors, are widely known by those skilled in the art of connectors. U.S. Pat. Nos. 4,938,711 and 4,902,243 disclose two prior art connectors of this kind that terminate cables by means of piercing devices on contacts. These piercing devices separate cable conductors upon insertion and cut away the insulation surrounding them when connector housings and termination covers are connected. FIG. 1 is a partially cut-away, elevational view generally showing one of the two prior art connectors used to terminate a ribbon cable. FIG. 2 is an enlarged schematic view of a part of FIG. 1, showing the details of two piercing devices on one of the outermost contacts and a neighboring contact respectively, wherein the two piercing devices are inserted into the ribbon cable.

Referring to FIGS. 1 and 2, the connector includes a number of contacts 70 attached to a connector housing (not labeled). Each contact 70 has a piercing device at the end distant to the connector housing. Each piercing device has a pair of insulation piercing points. One of the outermost contacts has a piercing device indicated by reference number 701 that is composed of an outer and inner insulation piercing points 7011 and 7012. When the connector housing is connected with a termination cover (not labeled) to terminate the ribbon cable, the piercing devices are first inserted into the ribbon cable to separate conductors (not labeled), as shown by FIG. 2. Further insertion of the piercing devices causes the insulation surrounding the conductors to be cut away and the insulation piercing points to engage with the conductors, whereby the connector and the ribbon cable are mechanically and electrically connected.

The above mentioned prior art connector is found to have the disadvantages as set forth below.

First, when the piercing devices are inserted through the ribbon cable to separate the conductors and cut away the insulation surrounding them, the movement of the outer insulation piercing points of the piercing devices on the outermost contacts, which include the insulation piercing point 7011, cannot always be properly restrained and guided. During such operation, this may cause the concerned insulation piercing points to become improperly deformed and have poor or no engagement with corresponding conductors.

Secondly, with the advancement of computer technology, insulation displacement connectors are required to have more contacts placed in smaller and smaller connectors (i.e. high density connectors). However, the structure of the prior art connector is not suitable for such a purpose since the prior art connector lacks a locating member which can securely fix the position of the piercing devices to make sure that when the connector terminates the ribbon cable, the piercing devices can always precisely and correctly engage with the conductors in the ribbon cable. An imprecise engagement between the piercing devices and the conductors may cause a poor signal transmission between the cable and the connector.

Therefore, one objective of the invention is to provide an insulation displacement connector whose outer insulation piercing points of the piercing devices on the outermost contacts can always be properly restrained and guided when the connector terminates a ribbon cable.

Another objective of the invention is to provide an insulation displacement connector equipped with a locating member for securely fixing piercing devices in position so that when the connector terminates a ribbon cable, the piercing devices can always precisely and correctly engage with the conductors in the cable. Thus, the insulation displacement connector according to the present invention can also function well when it is constructed as a high density connector.

SUMMARY OF THE INVENTION

According to an aspect of the invention, an insulation displacement connector includes a connector housing consisting of an upper mating face for receiving a mating connector, an opposed lower locating member receiving face, and a number of contact passages extending therebetween. A number of contacts each has a tab extending through one of the contact passages, a piercing device and a connecting section between the tab and the piercing device. Each piercing device has a pair of insulation piercing points. A locating member is attached to the connector housing about the locating member receiving face. The locating member engages with the connecting sections of the contacts to securely fix the contacts in position. The locating member consists of two pairs of guides, one pair on each lateral side thereof. A termination cover is fixed to the connector housing and has a number of recesses for receiving the piercing devices. The guides of the locating member extend into the termination cover and guide and restrain the movement of the outer insulation piercing points of the piercing devices on the outermost contacts when the connector terminates a cable. The outermost contacts are the contacts which are located most distant from a middle line amid two lateral sides of the connector housing.

DETAILED DESCRIPTION OF THE PREFERRED EMBODIMENT

References will now be described in detail to the preferred embodiment of the invention. While the present invention has been described in with reference to the specific embodiment, the description is illustrative of the invention and is not to be construed as limiting the invention. Various modifications to the present invention can be made to the preferred embodiment by those skilled in the art without departing from the true spirit and scope of the invention as defined by appended claims.

Figure 1:
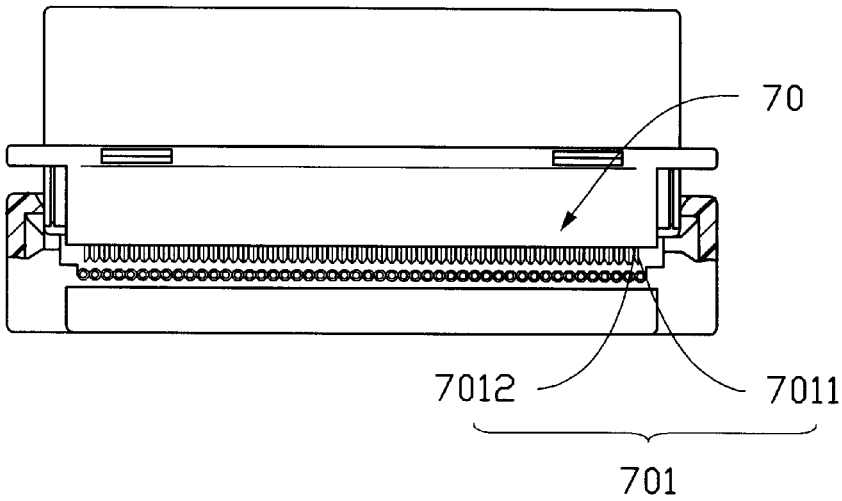
FIG.1 (PRIOR ART)
FIG. 1 is a partially cut-away, elevational view showing a prior art insulation displacement connector to terminate a ribbon cable.
Figure 2:
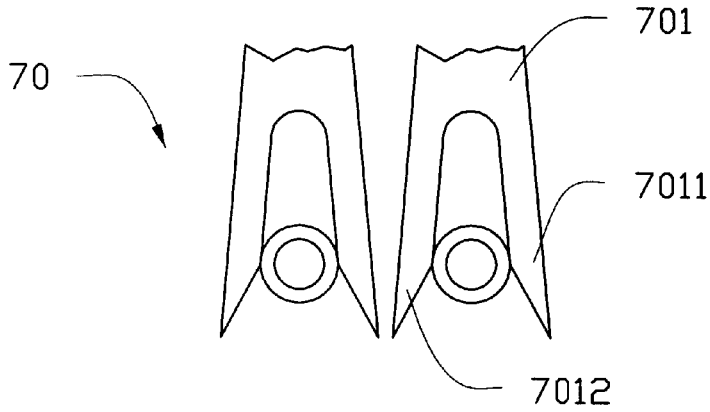
FIG.2 (PRIOR ART)
FIG. 2 is an enlarged schematic view of a part of FIG. 1 showing the details of two piercing devices at one of the outermost contacts and a neighboring contact respectively, wherein the two piercing devices are inserted into the ribbon cable.
Figure 3:
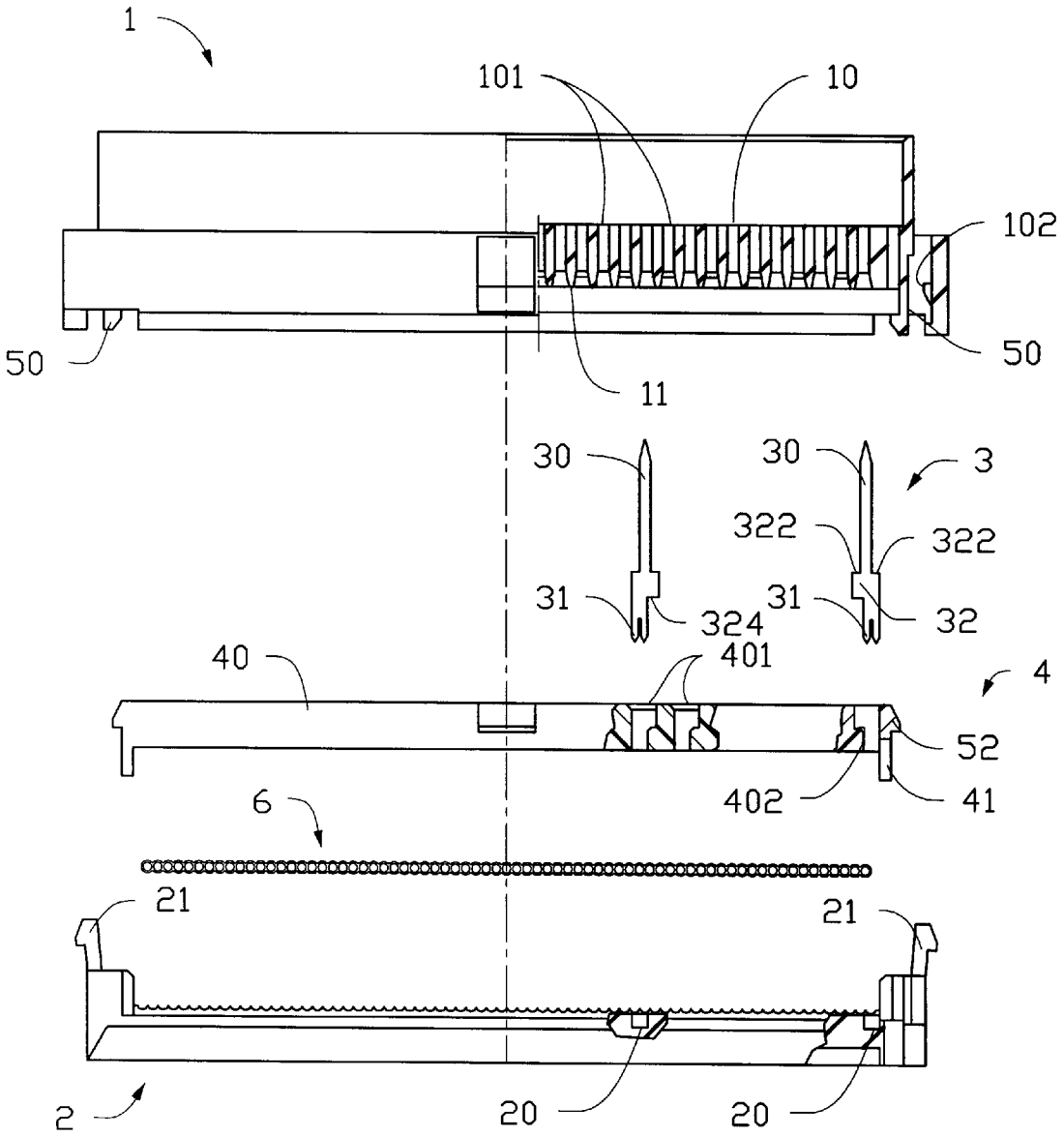
FIG. 3 is a partially cut-away elevational view showing the elements for constituting an insulation displacement connector in accordance with the present invention and a ribbon cable.

Referring to FIG. 3, an insulation displacement connector in accordance with the present invention generally includes an elongated connector housing 1, a termination cover 2 and a locating member 4. All of these elements are made of molded insulative materials (plastics for example), and contacts 3 are made of stamped conductive materials (for example, phosphorus bronze).

The connector housing 1 defines an upper mating face 10 for receiving a mating connector (not shown), an opposed lower locating member receiving face 11 and contact passages 101 extending therebetween. A pair of first stops 102 (only one being shown) are formed on inner faces of two lateral sides of the connector housing 1. A pair of first hooks 50 are formed between the first stops 102 and the contact passages 101 and located at a position lower than that of the first stops 102. Two locking holes 51 (also referring to FIG. 5(A) and only one hole being shown) are formed on a middle portion of a front and rear walls of the connector housing 1.

Each of the contacts 3 consist of a tab 30, a piercing device 31, and a connecting section 32 between the tab 30 and the piercing device 31. The connecting section 32 defines two upper stepped portions 322 with two side edges of the tab 30,and a lower stepped portion 324 with a side edge of the piercing device 31. The piercing device 31 includes a pair of insulation piercing points (inner point 31*a*, outer point 31*b*).

Figure 5:
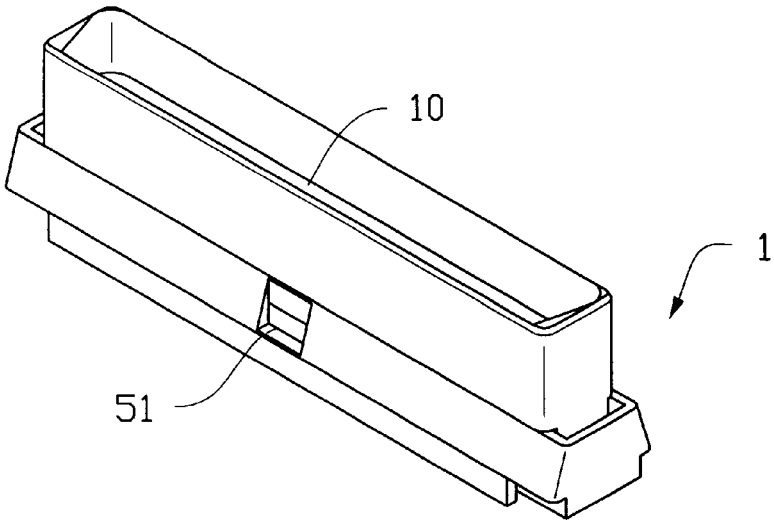
FIG. 5(A) is a perspective view showing the connector housing.
FIG. 5(B) is a perspective view showing the locating member in an inverted manner in comparison with those shown in FIGS. 3 to 5(A).
Figure 5:
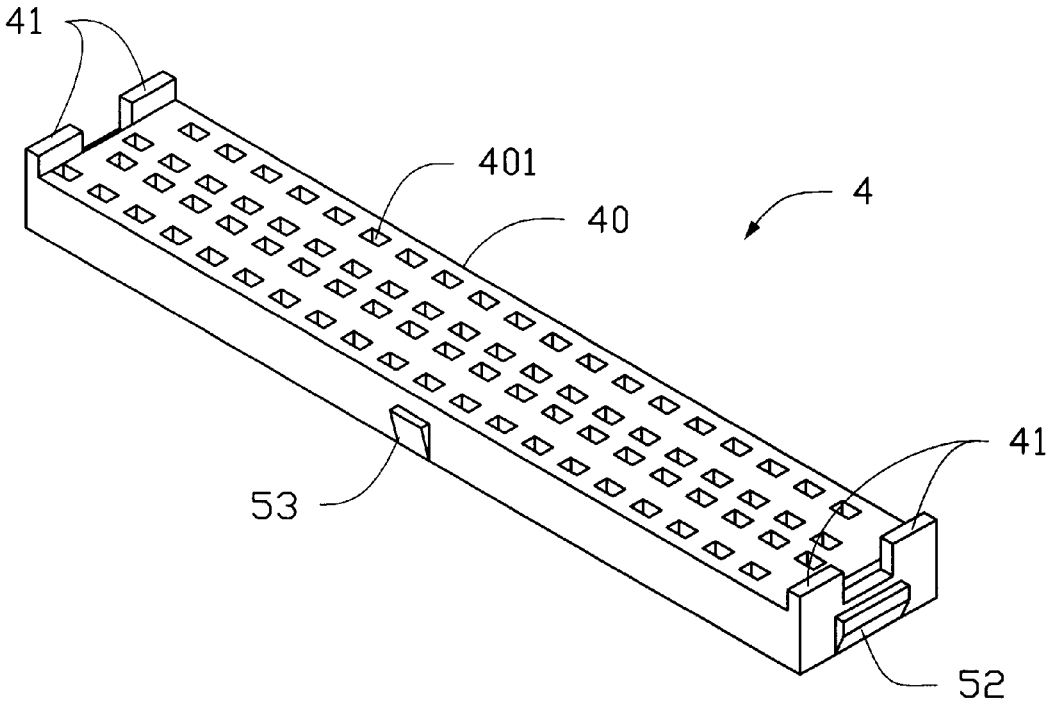

Also referring to FIG. 5(B), the locating member 4 consists of a body 40 and a pair of second stops 52 (only one being shown in FIG. 5(B)) on outer faces of two lateral sides of the body 40. Two pairs of guides 41 are respectively extended downwards from the two lateral sides of the body 40 (note: the locating member 4 in FIG. 5(B) is in an inverted position.) Two locking keys 53 (only one being shown) are formed on a middle portion of a front and rear walls of the body 40. A number of locating holes 401 are formed through the body 40 of the locating member 4. The number of locating holes 401 is the same as the number of contact passages 101, and are in alignment therewith when the locating member 4 and the connector housing 1 are connected. Each of the locating holes 401 defines a stepped side 402, and has a configuration meeting that of the lower stepped portions 324 of the connecting sections 32 of the contacts 3.

The termination cover 2 consists of a pair of second hooks 21 extending upwards from two lateral sides thereof. Furthermore, a number of recesses 20 are formed on a top face of a bottom wall of the termination cover 2. The number of recesses 20 is the same as the number of the locating holes 401, and are in alignment therewith when the termination cover 2 is connected with the connector housing 1.

Figure 4:
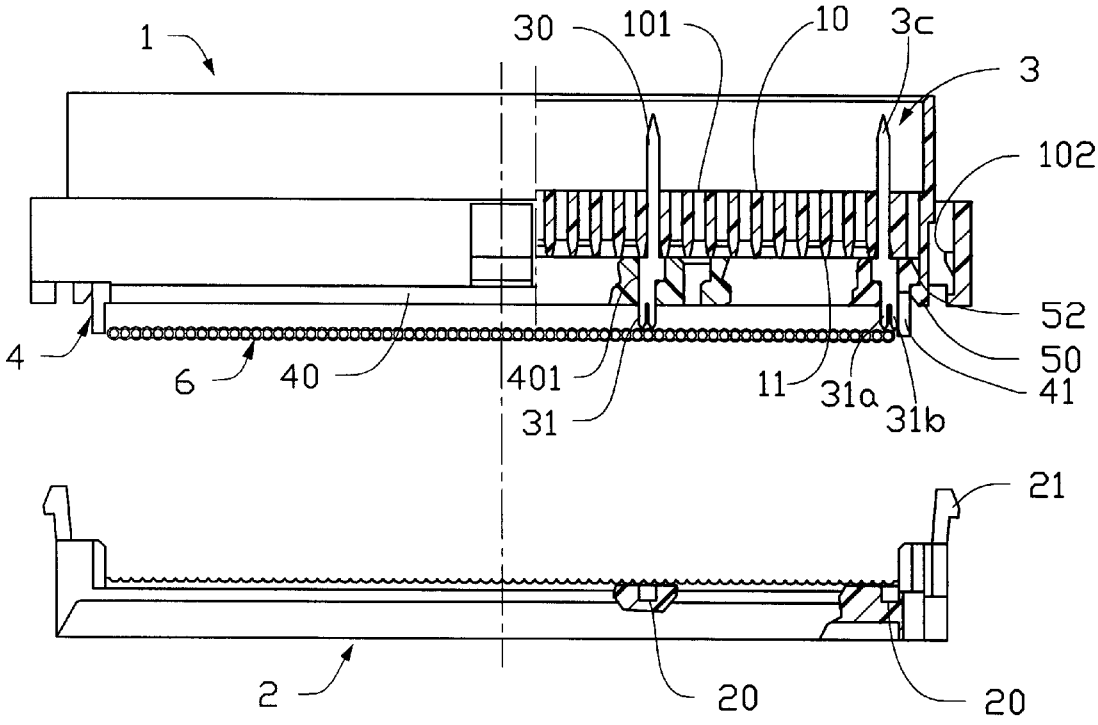
FIG. 4(A) is a view similar to FIG. 3, but shows that a connector housing, contacts and a locating member of the insulation displacement connector in accordance with the present invention are assembled together and the ribbon cable is put on piercing devices of the contacts.
FIG. 4(B) is a view similar to FIG. 4(A), but shows that the sub-assembly of FIG. 4(A) is further connected with a termination cover to complete a termination of the ribbon cable by the connector.
Figure 4:
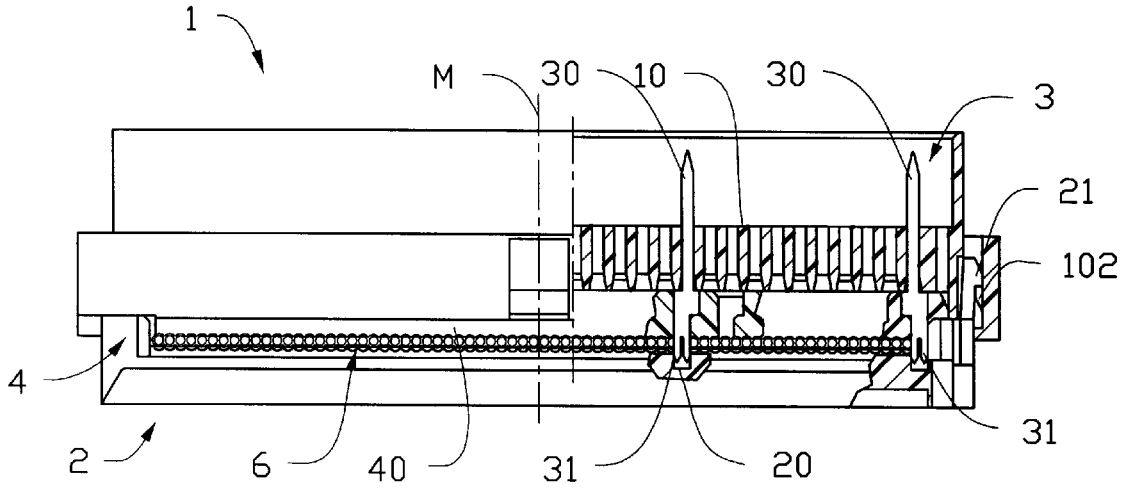

Now referring to FIG. 4(A), to assemble the connector and to terminate the cable 6 with the connector, firstly, the tabs 30 of the contacts 3 are brought to extend through the contact passages 101 from the locating member receiving face 11 to reach a position in which the upper stepped portions 322 abut the rear locating member receiving face 11. Then, the locating member 4 is brought together with the connector housing 1 and the contacts 3 by moving the locating holes 401 through the piercing devices 31 to reach a position in which the first hooks 50 are securely engaged with the second stops 52, and the locking keys 53 are securely engaged with the front and rear walls of the connector housing 1 about the locking holes 51. Once the connector housing 1, the contacts 3 and the locating member 4 are assembled, the lower stepped portions 324 of the contacts 3 are engaged with the stepped sides 402 of the locating holes 401, which, in cooperation with the abutment between the rear locating member receiving face 11 and the upper stepped portions 322, ensures the connecting sections 32 and thereby the contacts 3 to be securely fixed in position.

Thereafter, the ribbon cable 6 is brought to be located on the piercing devices 31, as shown by FIG. 4(A).

Finally, as shown by FIG. 4(B), the termination cover 2 is brought to connect with the connector housing 1 to complete the assembly of the connector and to terminate the cable 6 by engaging the second hooks 21 with the first stops 102. During this operation, the piercing devices 31 are inserted into the recesses 20 through the cable 6 to separate conductors thereof and cut away insulation surrounding them, whereby each piercing device 31 can engage with a corresponding conductor. When the termination cover 2 connects with the connector housing 1, the guides 41 are extended into the termination cover 2. In the present invention, the guides 41 restrain and guide the movement of the outer insulation piercing points of the piercing devices on the outermost contacts 3*c* located most distant from a middle line M amid the two lateral sides of the connector housing 1 when the piercing devices 31 are inserted through the cable 6. Thus, an improper deformation of the concerned insulation piercing points is avoided.

Since in the present invention, all the contacts are securely fixed in position by the help of the locating member 4, when the connector terminates the cable 6, the piercing devices 31 can precisely and correctly separate the conductors in the cable and engage therewith. Therefore, the present invention can ensure a very good connection between the connector and the cable even when the present invention is a high density connector.

Furthermore, due to the guides 41 of the locating member 4, the possible improper deformation of the outer insulation piercing points of the piercing devices on the outermost contacts of the prior art connectors will not occur in the present invention.

While the present invention has been described with reference to the specific embodiment, the description is illustrative of the invention and is not to be construed as limiting the invention. Various modifications to the present invention can be made to the preferred embodiment by those skilled in the art without departing from the true spirit and scope of the invention as defined by the appended claims.

Therefore, persons of ordinary skill in this field should understand that all such equivalent structures are to be included within the scope of the following claims.

I claim:

1. An insulation displacement connector for terminating a ribbon cable, comprising:

an elongated connector housing defining two lateral sides and a middle line amid the two lateral sides, the connector housing comprising an upper mating face for receiving a mating connector, an opposed lower locating member receiving face and a number of contact passages extending between the two faces;

a number of contacts each comprising a tab extending through a corresponding contact passage, a piercing device comprising a pair of insulation piercing points and a connecting section between the tab and the piercing device, the contacts having at least one outermost contact which is located most distant from the middle line of the connector housing, the piercing device of the outermost contact having an outer and inner insulation piercing points;

a termination cover fixedly and detachably connected with the connector housing; and a locating member separate from said termination cover and fixedly connected with the connector housing about the rear of said locating member receiving face, the locating member defining two lateral sides comprising at least one guide located closely adjacent to the outer insulation piercing point of the piercing device on the outermost contact, the guide extending into the termination cover and guiding and restraining a movement of the outer insulation piercing point of the piercing device on the outermost contact to prevent an improper deformation thereof when the connector terminates the cable, whereby when assembled, the ribbon cable is sandwiched between the termination cover and the locating member.

2. The insulation displacement connector as described in claim 1, wherein the termination cover comprises a number of recesses for receiving the piercing devices.

3. The insulation displacement connector as described in claim 1, wherein the locating member engages with the connecting sections of the contacts to securely fix the contacts in position.

4. The insulation displacement connector as described in claim 3, wherein the locating member comprises a number of locating holes for receiving the connecting sections of the contacts, each of the locating holes defining a stepped side, and each of the correcting portions of the contacts comprises at least an upper stepped portion engaging with the rear locating member receiving face, and a lower stepped portion engaging with one of the stepped sides of the locating holes.

5. The insulation displacement connector as described in claim 4, wherein the connecting section comprises two upper stepped portions formed with two side edges of the tab, and the lower steeped portion is formed by the connecting section with a side edge of the piercing device.

6. The insulation displacement connector as described in claim 1, wherein each of the two lateral sides of the connector housing comprises a first stop, and the termination cover comprises two lateral sides each defining a first hook, the termination cover being connected with the connector housing by engaging the first hooks with the first stops.

7. The insulation displacement connector as described in claim 6, wherein the connector housing comprises a pair of second hooks located between the first stops and the contact passages respectively, and the locating member has two lateral sides each defining a second stop, the locating member being connected with the connector housing by engaging the second hooks with the second stops.

8. The insulation displacement connector as described in claim 7, wherein the connector housing comprises a front and rear walls each defining a locking hole at a middle portion thereof, and the locating member comprises a front and rear walls each defining a locking key about a middle portion thereof, the locking keys engaging the front and rear walls of the connector housing about the locking holes when the locating member is connected with the connector housing.

9. The insulation displacement connector as described in claim 7, wherein the second hooks are at a position lower than that of the first stops.

10. A method for assembling a connector with a flat cable, said connector including a housing, a termination cover and a locating member wherein the housing includes a plurality of passages, the termination cover includes a corresponding member of recesses and the locating member includes a corresponding number of locating holes for commonly receiving a corresponding number of contacts therein, the assembling steps comprising:

fastening the locating member to a rear locating member receiving face of the housing by first locking means wherein the contacts are latchably engaged within the corresponding locating holes, respectively; and fastening the termination cover to the housing by second locking means wherein the flat cable is sandwiched between the locating member and the termination cover, and the contacts pierce the flat cable and enter into the corresponding recesses, wherein a pair of guides extending downward from two lateral sides of the locating member invade the termination cover and abut against piercing devices of two outermost contacts adjacent said two guides.

11. The method as described in claim 10, wherein the first locking means comprises a locking key and a locking hole on the locating member and the housing respectively for latching the locating member and the housing together.

* * * * *